US006210034B1

(12) United States Patent
Latini

(10) Patent No.: US 6,210,034 B1
(45) Date of Patent: Apr. 3, 2001

(54) DEVICES FOR LEAKPROOFING INSTRUMENT-CONTROL BUTTONS, PARTICULARLY FOR THE WINDING AND TIME-SETTING BUTTONS OF WATCHES

(75) Inventor: Bruno Latini, Greve In Chianti (IT)

(73) Assignee: Cartier International B.V., Amsterdam (NL)

( * ) Notice: Subject to any disclaimer, the term of this patent is extended or adjusted under 35 U.S.C. 154(b) by 0 days.

(21) Appl. No.: 09/381,330

(22) PCT Filed: Mar. 19, 1998

(86) PCT No.: PCT/EP98/01618

§ 371 Date: Sep. 20, 1999

§ 102(e) Date: Sep. 20, 1999

(87) PCT Pub. No.: WO98/43138

PCT Pub. Date: Oct. 1, 1998

(30) Foreign Application Priority Data

Mar. 21, 1997 (IT) ..... RM97A0159

(51) Int. Cl.[7] ..... G04B 37/10
(52) U.S. Cl. ..... 368/289; 368/319
(58) Field of Search ..... 368/288–290, 368/319–321

(56) References Cited

U.S. PATENT DOCUMENTS 424,191 3/1890 Fitch .
2,954,665 * 10/1960 Panerai et al. .
3,686,883 * 8/1972 Tarusawa .
4,292,682 * 9/1981 Wenger ..... 368/289

FOREIGN PATENT DOCUMENTS 673 197 2/1990 (CH) .
1 166 504 11/1958 (FR) .
364 878 1/1932 (GB) .
WO 97/46921 12/1997 (WO) .

* cited by examiner

*Primary Examiner*—Vit Miska
(74) *Attorney, Agent, or Firm*—Finnegan, Henderson, Farabow, Garrett & Dunner, L.L.P.

(57) ABSTRACT

A device for leakproofing instrument-control buttons, particularly for the winding and time-setting buttons (3) of watches, comprises a sealing element (8) fitted on the casing of the instrument in order to form a leaktight seal against the button, as well as a bridge unit (7) beneath which the button projects laterally and which carries an articulated lever (1) having a cam appendage (2) for pressing the button against the sealing element in a first position and for releasing the button to permit conventional movements thereof in a second position, the upper portion of the button (3) being machined in a manner such that a compartment is formed therein for housing a small piston element (4) in an axially slidable manner, the cam appendage (2) of the articulated lever (1) acting on the piston element (4), which is urged axially outwardly by resilient means (5) so as to take up clearance created between the button (3) and the casing.

3 Claims, 4 Drawing Sheets

DEVICES FOR LEAKPROOFING INSTRUMENT-CONTROL BUTTONS, PARTICULARLY FOR THE WINDING AND TIME-SETTING BUTTONS OF WATCHES

The present invention relates in general to devices for leakproofing instrument-control buttons, for example, for the winding and time-setting buttons of watches and, in particular, relates to an improvement in these devices for preventing some problems occurring therein.

The problem of the leaktight sealing of the casing of an instrument which has to operate in a fluid medium the penetration of which inside the casing would damage the mechanisms contained therein is known. A characteristic but non-limiting case is that of an instrument for under-water use.

It should be pointed out that, although, for simplicity of explanation, the present description relates to a watch, since the latter has the characteristic winding and time-setting mechanism, the following description has no limiting significance with regard to the type of instrument to which the invention may be applied, moreover the mention of water as the fluid to be prevented from penetrating the instrument has no limiting significance.

As far as is known, the closest prior art is represented by Italian patent No. 545,668 filed on Nov. 30th 1955. This patent provides for a sealing element fitted on the casing of the instrument and acting on the winding button thereof, leaving the winding shaft actually free of contact with the sealing element.

In one embodiment, means fitted on the casing of the instrument enabled the winding button to be pressed against the sealing element by means of a deliberate action from the exterior, the means being such as to leave the button free to be rotated at will for winding, or to be moved axially in order to engage the time-setting mechanism.

In another embodiment, the casing of the instrument had means exerting a constant stress such that the leaktight relationship between the sealing element and the winding button was always kept effective, these means having to be overcome, in particular, in order to perform the axial movement necessary for setting the time, whereas the leaktightness between the sealing element and the button was, in any case, not affected by their relative rotation.

With reference to FIG. 1, it can be seen that, although the device of the prior patent has considerable and decisive merits in comparison with the prior art at that time, it has disadvantages and limitations, as will now be explained.

In the first place, very great precision is required in the execution of the coupling between the appendage 7 of the lever and the surface of the head of the button in order to achieve a well-calibrated pressure and to keep the lever securely in the closure position in the groove formed in the mounting 1.

In the second place, within a short time, the friction of the appendage 7 of the lever 2 against the head of the button 3 brings about a reduction in pressure owing to wear of the softer material, causing a deterioration in leaktightness and possibly water penetration. Moreover, the lever no longer remains locked perfectly in the closure position in the groove of the mounting 1 but, since a certain clearance has been created, can come out partially, becoming vulnerable to knocks which could cause it to open completely and break and, in any case, compromising the appearance of the watch.

The object of the present invention is to solve these specific problems.

The specific subject of the present invention is therefore a device for leakproofing instrument-control buttons of the type described above, in which the upper portion of the button is machined in a manner such that a compartment is formed therein for housing a small piston element in an axially slidable manner, the cam appendage of the articulated lever acting on the small piston which is urged axially outwardly by resilient means so as to take up clearance created between the button and the casing.

In the preferred embodiment, the resilient means are constituted by a "Belleville" washer and the small piston is clamped by means of a retaining ring.

Further characteristics and advantages of the present invention will become clear from the following description, given with reference to the appended drawings which show the preferred embodiment by way of non-limiting example.

Figure 1:
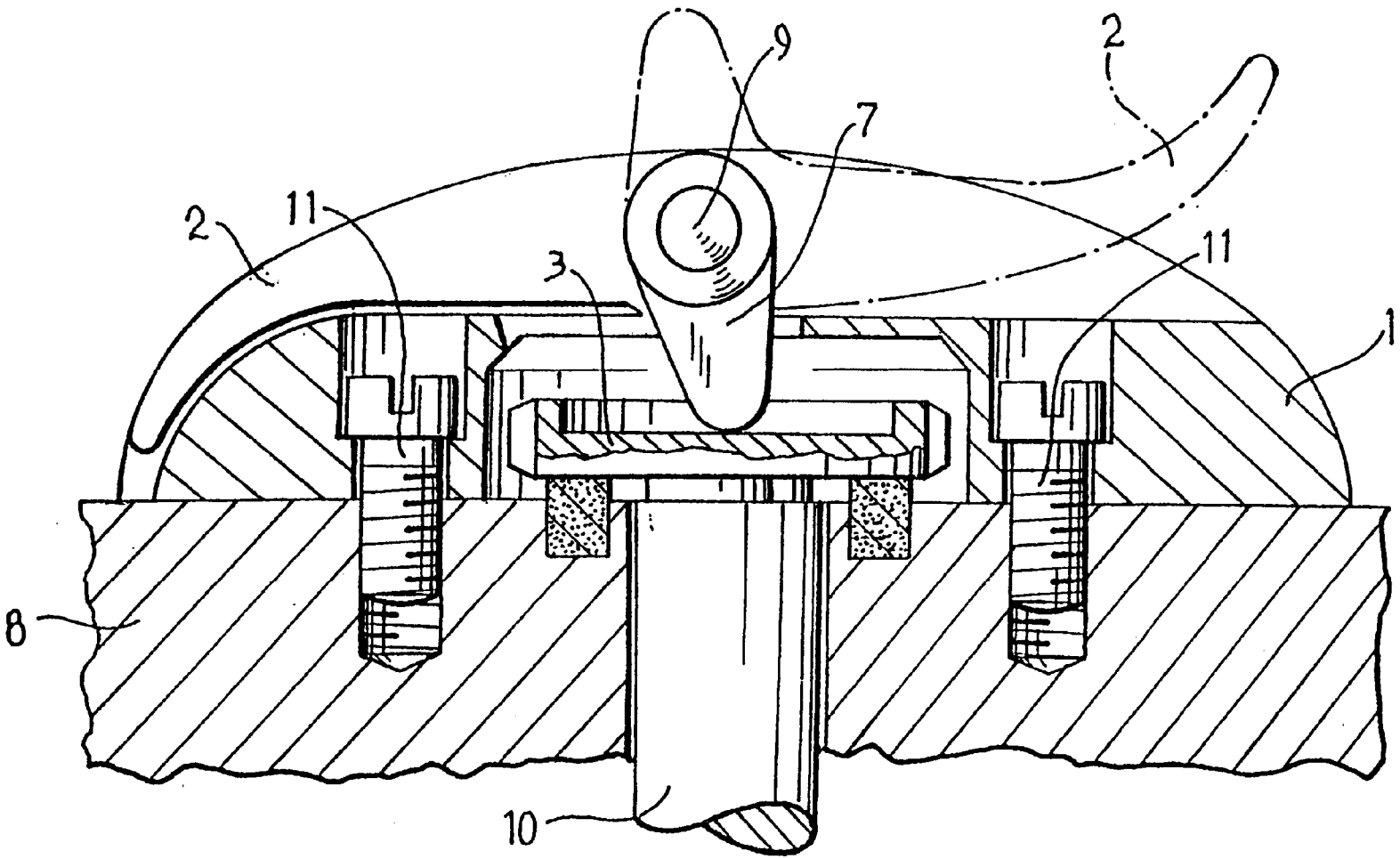
FIG. 1 PRIOR ART
FIG. 1 shows a construction according to the prior art.
Figure 2:
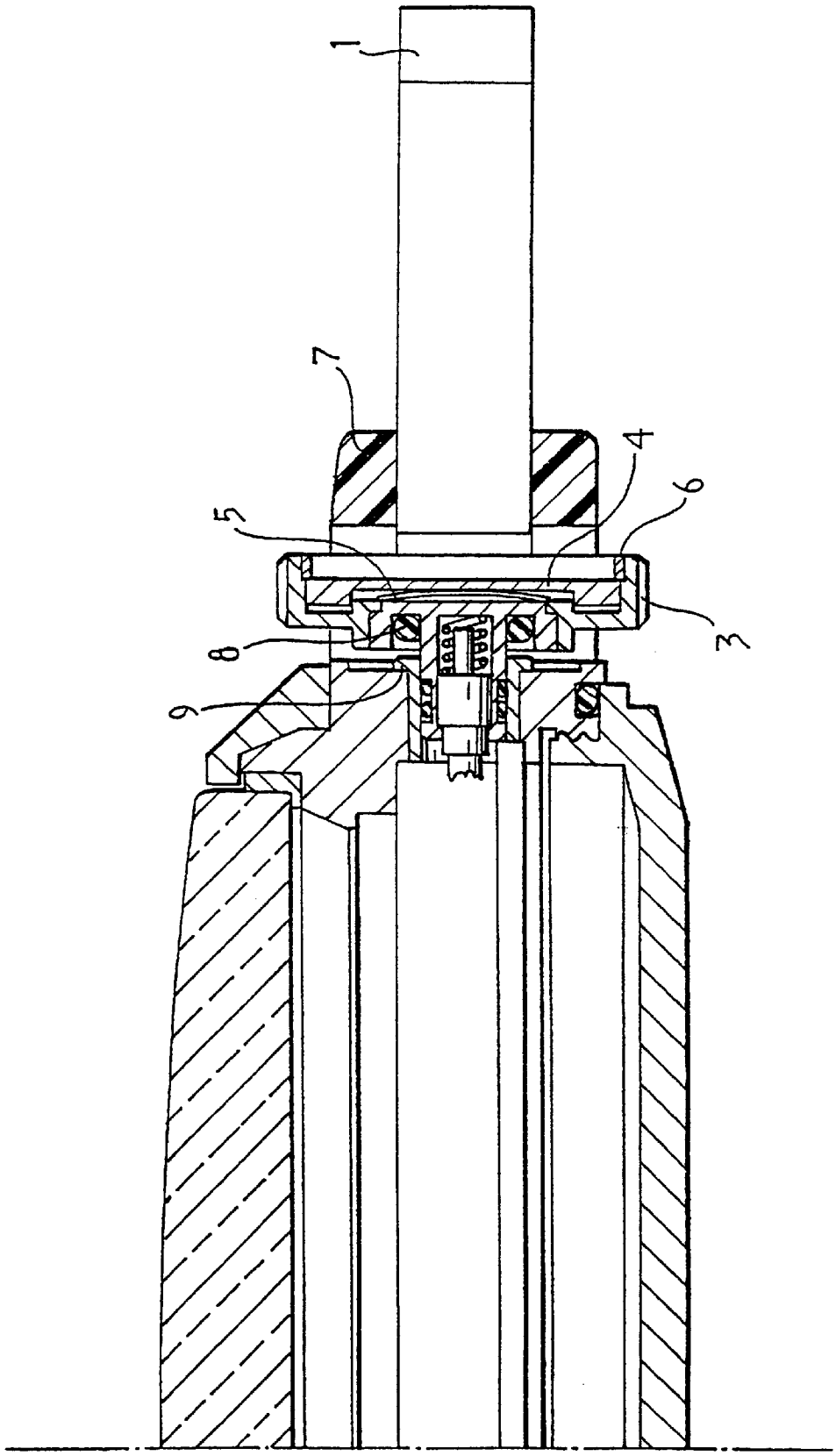
FIG. 2 is a vertically-sectioned view of the device of the present invention with the lever in the open position.
Figure 3:
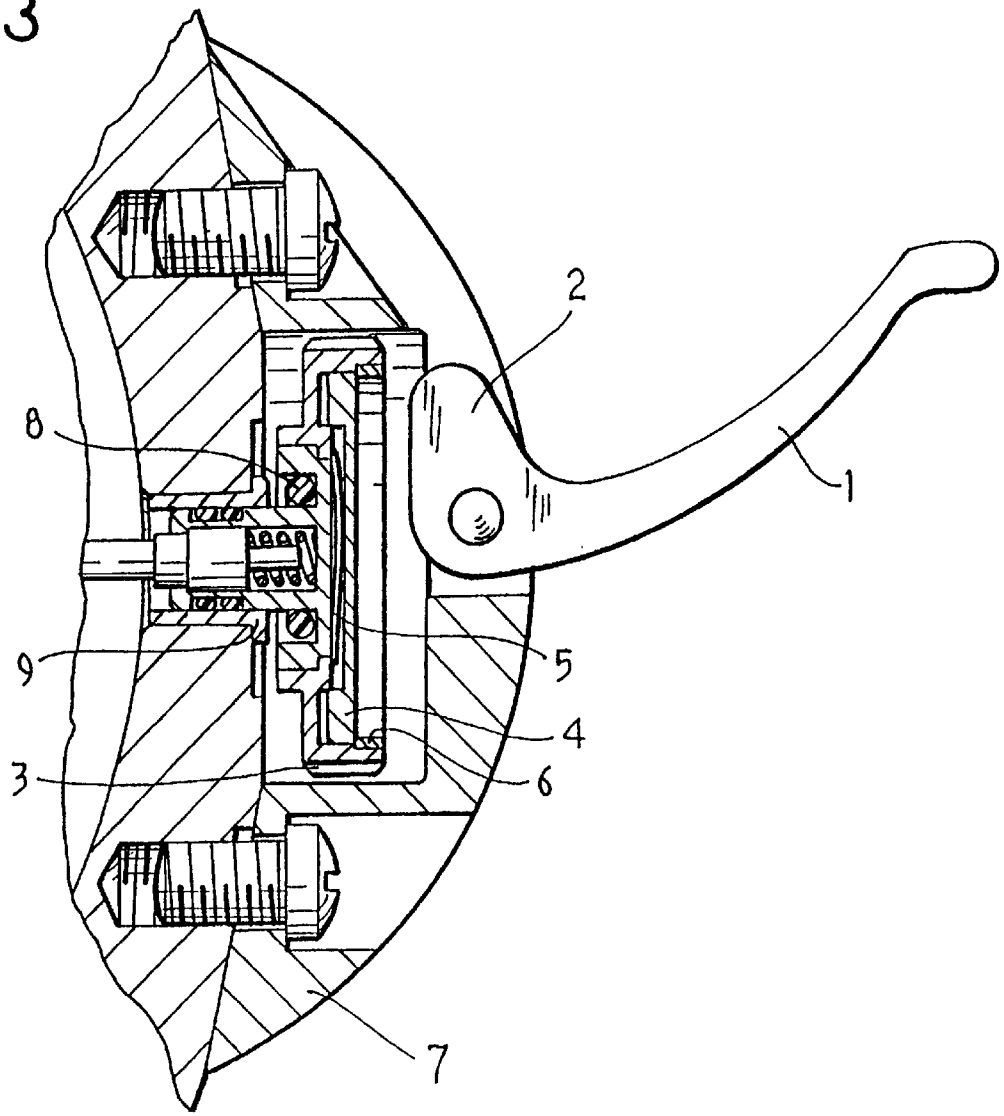
FIG. 3 is a horizontally-sectioned view of the device of FIG. 2.
Figure 4:
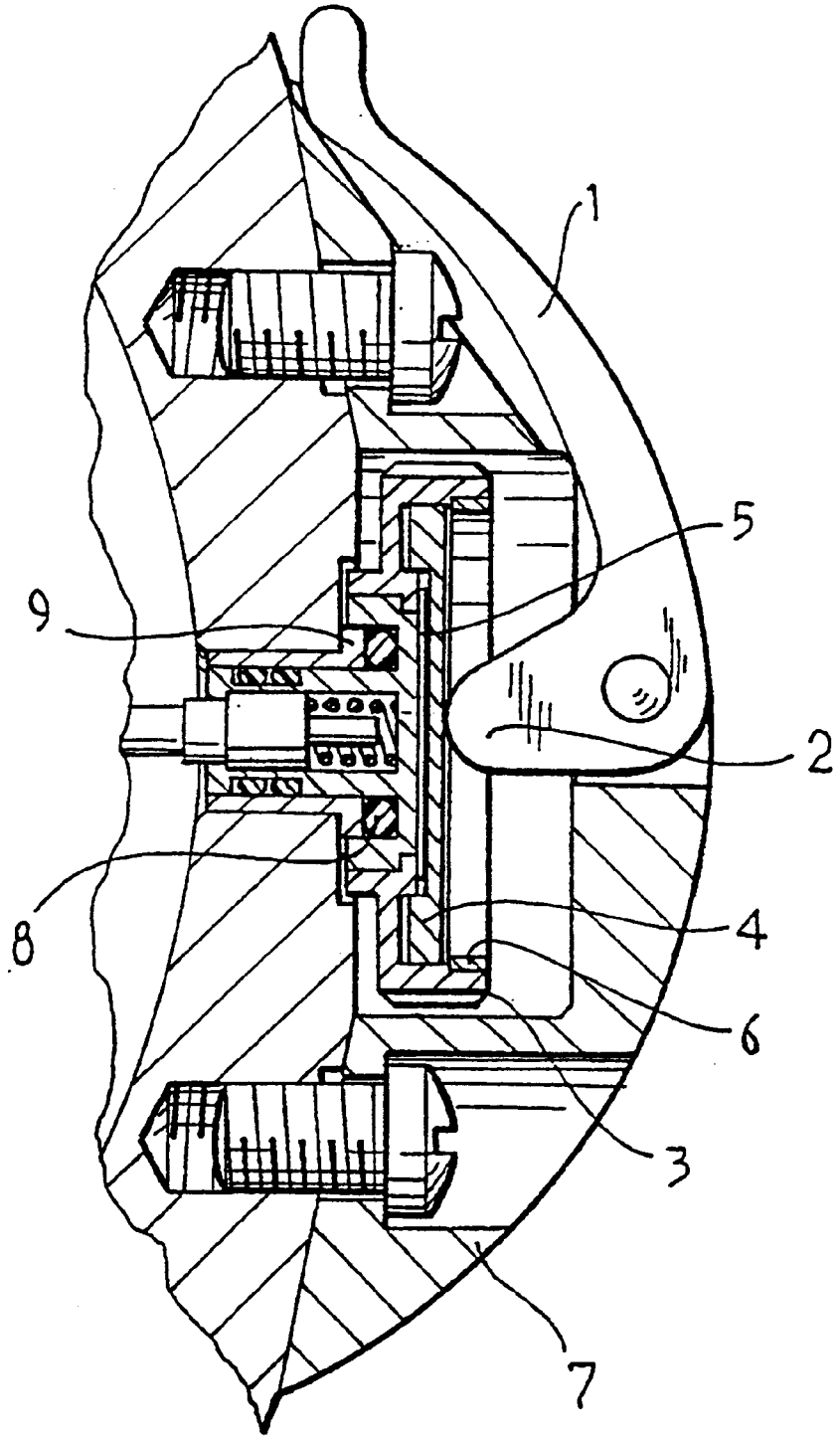
FIG. 4 is a horizontally-sectioned view corresponding to FIG. 3 but with the lever in the closed position.

With reference to FIGS. 2, 3 and 4, it can be seen that the improvement proposed for eliminating the problems of the prior art consists essentially of a structural modification of the components of the winding and time-setting button assembly so as to enable a resilient element to be fitted between the appendage of the lever and the upper portion of the button on which it is to act.

In particular, it can be seen that the upper portion of the button 3 is machined so as to form therein a small compartment which permits the insertion of a "Belleville" washer 5 and a small piston 4, by which it is held in place.

The small piston 4 can slide axially in the compartment of the button 3 and presses against the Belleville washer 5 but is clamped at the top to prevent it from coming out by a retaining ring 6.

With reference to FIGS. 3 and 4, it can be seen that, when the lever 1 is rotated anticlockwise, its cam appendage 2 comes into engagement with the small piston 4 and moves it downwards, so as to compress the Belleville washer 5 which performs the two functions of keeping the lever 1 in place and taking up clearance created as a result of wear.

As in the construction of the prior art, leaktight closure is achieved by compression of an O-ring seal 8 which is pressed against the rim 9 of the winding-shaft barrel.

A mounting on which the lever 1 is mounted for pivoting is indicated 7.

The foregoing description relates to the preferred embodiment of the present invention but, clearly experts in the art may apply variations, modifications and changes to the components and the details of construction, without thereby departing from the scope of protection of the present industrial rights.

What is claimed is:

1. A device for leakproofing instrument-control buttons, particularly for a winding and time-setting button of a watch, comprising a sealing element fitted on the casing of the instrument in order to form a leaktight seal against the button, as well as a bridge unit beneath which the button projects laterally and which carries an articulated lever having a cam appendage for pressing the button against the sealing element in a first position and for releasing the button to permit conventional movements thereof in a second position, said button having an upper portion machined in a manner such that a compartment is formed therein for housing a small piston element in an axially slidable manner, the cam appendage of the articulated lever acting on the small piston which is urged axially outwardly by resilient means so as to take up clearance created between the button and the casing.

2. A leakproofing device according to claim 1, wherein the resilient means is a "Belleville" washer.

3. A leakproofing device according to claim 1, wherein the small piston is clamped by means of a retaining ring.

* * * * *